US005755284A

United States Patent [19]

Hart et al.

[11] Patent Number: 5,755,284

[45] Date of Patent: May 26, 1998

[54] EXTENDED WEAR ROD GUIDE AND METHOD

[75] Inventors: Charles M. Hart, Stinnett; H. Milton Hoff, Tomball; Randall G. Ray, Spring; Stephen L. Witte, Sr., The Woodland, all of Tex.

[73] Assignee: Flow Control Equipment, Inc., Tomball, Tex.

[21] Appl. No.: 821,716

[22] Filed: Mar. 20, 1997

Related U.S. Application Data

[63] Continuation of Ser. No. 436,767, May 8, 1995, abandoned, which is a continuation-in-part of Ser. No. 251,212, May 31, 1994, abandoned, which is a continuation of Ser. No. 58,106, May 6, 1993, Pat. No. 5,339,896.

[51] Int. Cl.[6] ..... E21B 17/10

[52] U.S. Cl. ..... 166/241.4; 166/176

[58] Field of Search ..... 166/172, 173, 166/174, 176, 241.1, 241.2, 241.3, 241.4

[56] References Cited

U.S. PATENT DOCUMENTS

| | | | |
|---|---|---|---|
| 1,801,294 | 4/1931 | Sutton | 166/241.3 |
| 3,104,134 | 9/1963 | Nielsen et al. . | |
| 3,282,344 | 11/1966 | Tripplehorn . | |
| 3,442,558 | 5/1969 | Sable . | |
| 3,516,494 | 6/1970 | Ward . | |
| 4,050,514 | 9/1977 | Prenn . | |
| 4,088,185 | 5/1978 | Carson . | |
| 4,606,417 | 8/1986 | Webb et al. . | |
| 4,858,688 | 8/1989 | Edwards et al. . | |
| 5,115,863 | 5/1992 | Olinger . | |
| 5,191,938 | 3/1993 | Sable . | |
| 5,247,990 | 9/1993 | Sudol et al. . | |
| 5,339,896 | 8/1994 | Hart et al. . | |

*Primary Examiner*—Joseph M. Gorski
*Attorney, Agent, or Firm*—Browning Bushman

[57] ABSTRACT

A rod guide is provided for centering a sucker rod within a tubular string that powers a pump within a wellbore. The rod guide comprises a rotor secured to the sucker rod and having upper and lower stop surfaces thereon, and a sleeve formed from metal to substantially increase the life of the rod guide. The rod guide stator has an elongate slot extending along its axial length. The stop surfaces limit axial travel of the stator on the sucker rod, and the sleeve prevents the stator from engaging the sucker rod. The sleeve may be retained on the rod by a clip, and plastic end members then molded over the clip and the ends of the metal sleeve. The stop surfaces may be formed by a ring member spaced axially between the upper and lower ends of the sleeve.

20 Claims, 5 Drawing Sheets

EXTENDED WEAR ROD GUIDE AND METHOD

RELATED APPLICATIONS

The present application is a continuation of U.S. Ser. No. 08/436,767 filed May 8, 1995, now abandoned, which is a continuation-in-part of U.S. Ser. No. 08/251,212 filed May 31, 1994 and now abandoned, which in turn is a continuation of U.S. Ser. No. 058,106, filed May 6, 1993, now U.S. Pat. No. 5,339,896.

FIELD OF THE INVENTION

The present invention relates to a guide for maintaining a rotatable rod generally aligned within a wellbore of an oil, gas, water, or geothermal well. More particularly, this invention relates to an extended wear rod guide for a rotating sucker rod commonly used to drive a downhole progressing cavity pump.

BACKGROUND OF THE INVENTION

Those skilled in the hydrocarbon recovery industry understand that pumps at the lower end of wells are conventionally used to pump oil to the surface via production tubing positioned within a well tubing. The pump is typically powered at the surface, with the power being transmitted through a rod string positioned within the production tubing. A rod string conventionally has been reciprocated to drive the downhole pump, although a progressing cavity pump driven by a rotating rod has been used, particularly in wells producing heavy, sand-laden oil or producing fluids with high water/oil ratios.

Whether the rod which drives the pump (the sucker rod) reciprocates or rotates, the rod generally is guided so that it does not rub against the interior walls of the production tubing, and thus cause excessive wear on either the sucker rod, the sucker rod couplings, or the production tubing. In practice, sucker rods and production tubing almost never hang perfectly concentric within a well. Moreover, few if any wells produce crude oil free of abrasives and water. These contaminants increase wear if the sucker rod string contacts the inside of the production tubing. Whether the pump driving system utilizes a reciprocating or a rotating rod, tubing wear and rod wear accelerate as production rates, hole deviations, water/oil ratios, and sand concentrations increase. While rod guides traditionally have thus long been used to generally center the rod within the production tubing, the need for improved rod guides increases with the changing variables discussed above.

Rod guides are traditionally spaced along the length of a rod string to prevent the rod string from engaging the tubing string. Various rod guide designs create a frictional grip on the rod in order to secure the rod guide in position. Field installed rod guides (FIGS) traditionally do not maintain their desired gripping engagement with the rod over a long period of time, particularly when high axial forces are encountered by the rod guide and when increasingly more power is transmitted from the surface to the downhole pump through the rod. While it is thus desirable that a rod guide be installed at the well site or at a location convenient to the well operator, FIGS traditionally are not able to achieve reliable engagement with the rod. Other versions of FIGS utilize a rubber guide body with a metal C-spring molded within the rubber body to supply a supplemental force which increases the frictional grip of the guide to the rod, as disclosed in U.S. Pat. No. 4,928,472. This latter type of rod guide is typically unfinned and has a high pressure drop, and also is generally unreliable at securing the guide to the rod. Another type of plastic FIG is similar in shape to the rubber rod guide body. The body is machined from UHMW polyethylene, and does not include a metal C-spring insert. This plastic guide is disclosed in U.S. Pat. No. 4,858,688.

Rod guides manufactured from plastic have been molded directly onto the rod. These molded-on rod guides, as disclosed in U.S. Pat. No. 4,088,185, thus have the advantage of more reliably engaging the rod to maintain the rod generally concentric within the tubing string. Molded-on rod guides are also relatively inexpensive to manufacture, although these prior art rod guides have the disadvantage of practically requiring that the entire rod be sent from the field to a molding facility to remove a worn-out guide and mold on a new guide, after which the rod with new guides may then be returned to the field. A rod guide with a diagonal slot designed for maintaining a guide on a rod is disclosed in U.S. Pat. No. 3,442,558, while a similar snap-on guide and scraper is disclosed in U.S. Pat. No. 3,282,344. A field installable rod guide is disclosed in U.S. Pat. No. 4,858,688.

U.S. Pat. No. 5,191,938 discloses one version of a rod guide including a cylindrical centralizer body which hinges open during a spreading operation for insertion on a mount provided on the rod guide shank. The centralizer body is returned to its cylindrical shape after installation, and centralizer body is welded to maintain its desired cylindrical form while on the rod. This type of rod guide has not proven to result in long life, and the operation of bonding the split body to its desired cylindrical form after installation is a drawback to easy field serviceability. An early version of a rod guide is disclosed in U.S. Pat. No. 3,516,494.

A rotatable rod guide may comprise a rotor which is fixed to the rotating rod, and a stator which remains generally stationary in the wellbore while engaging the tubing to guide the rotor and thus the rod. The rod guide rotor acts to prevent the rod guide stator from engaging and thus wearing against the rod itself. Stator bodies may be fabricated from UHMW polyethylene or other durable materials, so that wear on the stator inner surface is generally not a significant problem. The rod guide rotor may be molded on the rod with integral upper and lower stops as disclosed in U.S. Pat. No. 4,050,514. A significant problem with rotatable rod guides relates to a life of the bearing between the outer surface of rotor which is designed for engagement with the inner surface of the stator or guide body.

Those skilled in the art appreciate that even a relatively insignificant wear on a sucker rod may result in a stress point which could cause the rod to break. Since rod breakage typically requires significant repair costs and downtime, well operators generally are unwilling to allow a stator to directly contact a rotating rod because of fear that any rod wear will result in rod breakage. The cost of replacing worn rod guides on rotary sucker rods accordingly is a significant factor in the overall cost of operating a producing well with a rotating sucker rod.

Improved rotatable rod guides are thus required which will reliably protect the rod for extended periods of time. According to the present invention, multiple rotors may be securely affixed to a rod at selected positions along the length of rod, and a stator then field installed at the well site at a selected rotor position. New stators may thus be installed in the field on unused rotors after the originally installed guide wears out.

The disadvantages of the prior art are accordingly overcome by the present invention, and an improved rod guide suitable for use on a rotating rod string is hereinafter disclosed. The rod guide of the present invention is designed for a reliable operation over a relatively long period.

SUMMARY OF THE INVENTION

The rod guide of the present invention is designed for a use on a rotating rod string, and more particularly is designed for use on a rod string powering a progressing cavity pump. A rod guide rotor may include a metal sleeve and upper and lower stops affixed to the rod. The rod guide stator preferably has a slot along the length thereof and a plurality of radially outward projecting fins. The slot in the rod guide stator allows the stator to be spread apart and snapped onto the rotor, with the axial position of the stator being limited by the upper and lower stops. In one embodiment, the metal sleeve is provided with an axially centered stop ring which limits travel of the rod guide stator.

The rotor comprises a metal sleeve which prevents the stator from contacting the rod and extends the life of the rod guide. Upper and lower plastic stops may be injection molded on the rod. A metal snap ring may hold the sleeve on the rod during the molding process, and also retains the metal sleeve on the rod if a molded plastic stop wears away and breaks off while the rod guide is downhole. The metal snap ring may be axially recessed slightly with respect to a stop surface on each upper and lower stop designed for engagement by the stator. Top and bottom ends of the stator may include a plurality of scalloped cut-outs which facilitate flushing of the rod guide to keep grit and debris from accumulating within the rod guide and thereby interfering with the free rotation of the guided rod within the stator. The metal snap rings provide a back-up wear surface for engaging the ends of the stator if the plastic stop surface is worn away during use of the rod guide.

The metal rotor sleeve may be formed from one or more pieces, and preferably covers at least 200° of the 360° circumference of the rod to adequately protect the rod from engagement with the stator. End stops may have a frusto-conical configuration to reduce fluid drag and pressure drop across the rod guide. Alternatively, the molded stops may be provided with cut-outs so that circumferentially spaced stop pads are provided for engagement with the ends of the stator. Other rotor embodiments secure a metal sleeve to the rod by frictional engagement, so that both the rotor and the stator may be field installed. The metal sleeve may be prevented from engaging the rod by a thin plastic or rubber layer, which also desirably increases the friction between the rod and the metal sleeve. This rubber layer also reduces corrosion by galvanic action between the metal rotor and the metal rod. The body of the stator may be tapered in the embodiment having an axially centered stop ring, so that the center of the stator body has a diameter greater than the upper and lower ends of the stator body. A pair of semi-circular ring members may be clamped around a metal sleeve, and the ends of the two ring members spot welded together to secure the metal sleeve on the rod. A plastic or rubber layer on the inner surface of the metal sleeve shields the rod from the welding process.

It is an object of the present invention to provide an improved rod guide for protecting an elongate rod of the type commonly used to drive a progressing cavity pump. More particularly, the rod guide of the present invention has a substantially enhanced life by providing a wear resistant sleeve member to protect the rod from being engaged by the stator. The sleeve member exterior surface thus serves as a durable bearing surface for engagement with the interior surface of the stator during rotation of both the rod and the rotor with respect to the stator.

It is a feature of this invention that the stator may be reliably retained on the rod even if a plastic rotor stop breaks off the rod. Another feature of the invention is that the metal sleeve may be physically separated from the rod by a relatively thin rubber layer. It is another feature of the invention that a plurality of rotors may be provided along the length of a rod, so that the user or well operator may snap a stator on selected ones of the rotors as new stators are needed.

It is an advantage of the present invention that a metal stop ring may be utilized to hold the metal sleeve on the rod. Upper and lower plastic stops may be molded adjacent each end of the metal sleeve. The metal snap ring may retain the sleeve on the rod even if a plastic stop were to break off the rod, and provides a back-up hardened wear surface for engaging the pad ends of the stator.

These and further objects, features, and advantages of the present invention will become apparent from the following detailed description, wherein reference is made to the figures in the accompanying drawings.

BRIEF DESCRIPTION OF THE PREFERRED EMBODIMENTS

Figure 1:
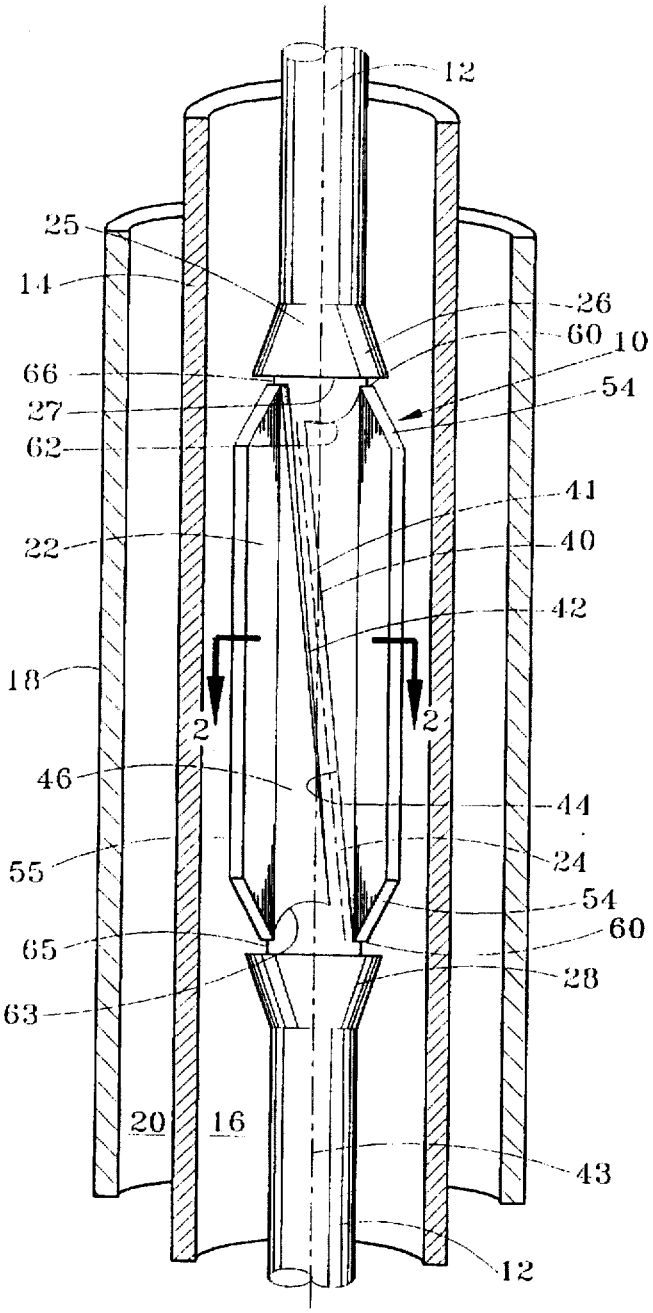
FIG. 1 is a side view of a rotating rod guide in accordance with the present invention.

FIG. 1 depicts a rotating rod guide according to the present invention. Those skilled in the art will appreciate that the rod guide 10 serves the purpose of maintaining the sucker rod 12 substantially centered within tubing 14, which in turn is substantially aligned and centered within the casing 18 defining a wellbore 20 extending from the surface to a subterranean formation. An annulus is thus formed between the I.D. of the casing 18 and the O.D. of a production tubing 14. The flow path 16 within the production tubing is conventionally used for passing contaminated oil to the surface. For the embodiment depicted in FIG. 1, the rod 12 is rotated to drive progressing cavity pump (not shown) at the lower end of the wellbore 20. The rod guide 10 prevents the sucker rod 12 and the couplings (not shown) which interconnect lengths of sucker rods from engaging the inner surface of the tubing string 14. The downhole pump, in turn, passes contaminated oil up through the flow path 16 in the production tubing 14. Accordingly, the pump must overcome the pressure loss attributable to the restriction in the flow path 16 caused by the rod guide 10.

The rod guide 10 comprises a guide body or stator 22 having a generally C-shaped cross-sectional configuration created by an elongate slot 40 extending along the length thereof. The width of elongate slot 40 is thus defined by the spacing between the opposing sidewalls 42 and 44 on the stator 22. The slot 40 may be inclined at a slight angle of approximately 10°, and accordingly the slot centerline 41 is angled as shown in FIG. 1 with respect to the rod guide centerline 43.

The rod guide 10 also includes a rotor or spool member 25, which comprises a relatively thin sleeve member 24 and upper and lower end members 26, 28 at the opposing ends of the sleeve member 24. Each of the end members 26, 28 has a frustoconical configuration which reduces the pressure loss across the rod guide by providing for streamline flow. Each end member includes planar stop surface 27, which lies within a plane substantially perpendicular to the central axis 43 of the rod guide. A gap 66 exists between the upper end of the stator 22 and the stop surface 27, and a similar gap 68 is shown between the lower end of the guide body and the stop surface on the lower end member 28.

Figure 2:
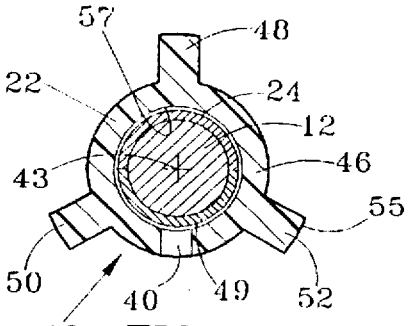
FIG. 2 is a cross-sectional view of the rotatable rod guide as shown in FIG. 1.

FIG. 2 is a cross-section view through the rod guide 10 shown in FIG. 1, and illustrates the rod guide symmetrically positioned about axis 43. The stator 22 comprises a radially inner body portion 46 having a substantially C-shaped cross-sectional configuration, and three ribs, vanes, or fins 48, 50, and 52 equally spaced circumferentially about and extending radially outward from the C-shaped portion 46. The ribs, fins or vanes 48, 50, and 52 minimize flow resistance around the guide, while desirably centralizing the rod 12 within the production tubing 14. A circle including the arc segments formed by the outer surface 55 of the fins 48, 50, and 52 preferably has a diameter slightly less than the I.D. of the tubing 14. Alternatively, the stator as installed on the rotor could have a diameter slightly greater than the I.D. of the tubing which receives the rod guide. As the rod guide is fitted within the tubing, its diameter decreases slightly, thereby maintaining the stator fins in forced engagement with the tubing I.D. It should be understood that the I.D. 57 of the C-shaped portion 46 preferably is defined by the cylinder having a diameter slightly greater than the O.D. 49 of the sleeve member 24 of the rotor.

The slot 40 preferably has a nominal width (its normal width when the stator 22 is in a relaxed state) which preferably is less than the O.D. 49 of the sleeve member 24. The flexibility of the material used for the stator 22 thus allows the stator to be snapped on the rotor by simultaneously spreading the width of the slot 40 and moving the stator 22 radially inward toward axis 43, so that the stator becomes positioned on the sleeve member 24 and between the end members 26 and 28 of the rotor. The angle between the centerline 41 of the slot 40 and the central axis 43 of the stator improves the lock-on characteristics of the stator 22 to remain on the rotor. The preferred slot angle depends on the length of the stator and the circumferential spacing between the fins. If the body 22 is fabricated from less resilient materials, such as metal, it would be desirable for the slot to be straight and wide, thereby minimizing the amount of flexing required to install the stator.

In one preferred embodiment, the material for the stator 22 is an ultra-high molecular weight (UHMW) polyethylene material. This material is particularly preferred for the body of the rod guide according to the present invention, since the selected material is highly resistant to abrasion from sand and other particles contained in the fluid which is passed by the rod guide. This material has both good wear characteristics and a relatively low coefficient in friction when contacted with the same or other materials. Because of the UHMW characteristics of the stator 22, the stator is extruded then machined to its desired form rather than being injection molded. It should be understood that the stator could be formed from other materials. Nylon, Amodel, Hular, PPS, and bronze are examples of other materials which may be selected for fabricating the stator 22.

The provision of the slot 40 in the stator renders the rod guide of the present invention essentially field installable. A worn out stator 22 may be easily snapped off of the rotor, and a new stator 22 snapped on in a simple and inexpensive field operation. In addition to providing this desirable field replaceable characteristic for the rod guide body, slot 40 serves another purpose in that the substantial width of the slot allows for easy passage of fluid into and out of the annulus formed between the I.D. 57 of the radially inner body portion 46 of the stator and the O.D. 49 of the sleeve member 24 of the rotor. A substantially C-shaped annular gap is thus formed by this difference between diameters 57 and 49, and flowing fluid is available to continuously "wash" the rod guide when in use. This washing action allows the stator 22 to freely rotate relative to the rotor, and thus reduces frictional losses and abrasion between the inner surface of the stator and the outer surface of the rotor.

FIG. 1 also depicts upper cut-outs 62 and lower cut-outs 63 formed in the upper and lower ends of the stator 22. These cut-outs further serve to contribute to the flow of fluid which desirably washes the connection between the stator 22 and the rotor. Each of the cut-outs has a substantially semi-circular or scalloped configuration, and is formed extending circumferentially between the gap which exists between the ribs 48, 50, and 52. The inclined portion 54 of each rib extends from the inner body portion 46 of the stator 22 to the outer diameter surface 55 of the respective rib, and contributes to produce a relatively low pressure loss across the rod guide. The three cut-outs 62 as shown in FIG. 1 each occur over a circumferential length of from about 80° to about 100°, and preferably over a circumferential length of approximately 90°. Each of the three pads 60 formed at each end of the stator by the cut-outs 62 may be aligned with a respective rib, and may have a circumferential width of only about 30°. Each of the pads 60 thus engage the stop surface 27 on the end member 26, and this contact area is sufficient to prevent excessive wear of the pads 60. The substantially longer circumferential length of the scalloped cut-outs 62 (together totalling approximately 270° in a preferred embodiment) allow for the desired passage of fluids to wash between the body 22 and the rotor 25. As shown in the drawing, the scalloped cut-out configuration tapers upward to the contact point formed by the pad at the end of each rib. To still further provide for this desired washing effect, the substantially C-shaped gaps 66 and 65 provide a total axial clearance of from about 1 millimeter (mm) to approximately 3 mm or greater between the ends of the stator 22 and the stop surfaces on the end members of the rotor. The slot 40, in conjunction with the cut-outs 62, 63, the annulus between the surface 57 and 49, and the gaps 66 and 65, thus all contribute to maximize the flow of fluids around and through the rotating and stationary components, thereby reducing high abrasive rod guide wear.

Figure 3:
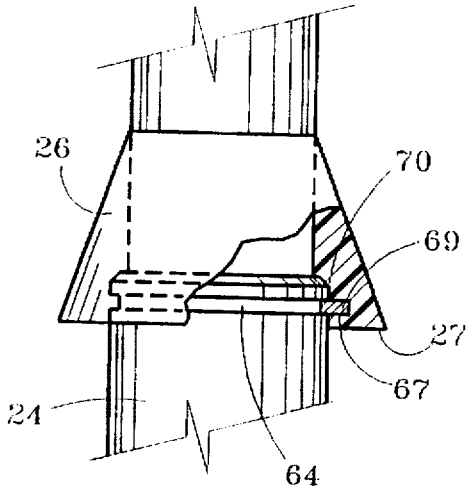
FIG. 3 is a pictorial view of a portion of the metal sleeve generally shown in FIG. 1, including particularly the groove for receiving the snap ring, and the position of the stop surface relative to the snap ring.

FIG. 3 depicts an upper portion of the sleeve 24 generally shown in FIGS. 1 and 2. The sleeve 24 may be fabricated from a sheet of hardened steel. The material thickness of the sleeve 24 is preferably minimized to desirably maintain a minimum diameter of the inner body portion 46 of the stator, although the sleeve 24 must be sufficiently thick to withstand anticipated wear as it rotates downhole within the stator and thereby prevents the stator 22 from engaging the rotating rod 12. The sleeve 24 may be less than 0.20 inches thick, and preferably has a minimum thickness of from 0.10 inches to 0.15 inches. If desired, a uniform stator with a fixed internal diameter may be used for each size sucker rod. In this case, the thickness of the sleeve may be increased from the thickness stated above (which are for the largest diameter rod), so that if the rod diameter decreased, the outer diameter of the sleeve remained substantially constant for receiving the uniform stator. As explained subsequently, a metal sleeve may be formed from two C-shaped components. The sleeve 24 includes a circumferential groove 64 formed in the upper and lower ends of the sleeve to receive a metal clip 66 which functions to hold the clip components together while the plastic end members 26 and 28 are molded on the rod 12.

Figure 4:
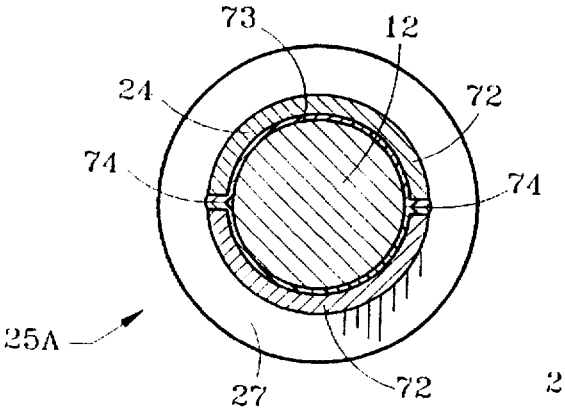
FIG. 4 is an alternate embodiment of a rod guide, illustrating a cross-sectional view of the sleeve and one of the stops, with the stator removed for clarity.

For the embodiment described above, the sleeve 24 is formed by two identical components 72 each having a 180° circumference. Accordingly, the elongate sides of the sleeve components butt into engagement, as shown in FIG. 4. During manufacture of the rotor 25, the sleeve components 72 are placed on a cleaned rod 12, and the clip 66 is slid over the ends of the components 72 and into the groove 64, thereby reliably holding the components 72 in place while the plastic end members 26 and 28 are molded on the rod. Each end of the sleeve 24 may include a chamfer 70 to facilitate installation of the clip 69. The end members cover the upper and lower ends of the sleeve 24 as shown, and also encapsulate the clip 69. The clip 69 is thus spaced axially opposite the stator 22 with respect to the plastic stop surface 27 on each end member 26 and 28.

After repeated use of the rod guide, the ends of the stator may wear away a portion of the plastic end members, so that the plastic stop surface 27 "moves" closer to the metal clip 69. The primary wear problem in a rotatable rod guide is between the internal surface of the stator and the external surface of the sleeve between the end members 26 and 28. The useful life of a rod guide is thus significantly increased by providing a metal sleeve on the rod to resist wear much better than a plastic material sleeve. A lesser wear problem is encountered between the ends of the stator and the end members on the rotor which limit axial travel of the stator. Nevertheless, the plastic stop surfaces 27 may wear after repeated engagement with an end of the stator, and particularly the stop surface 27 on the upper end member 26 (due to the upward force of the flowing fluid in the tubing 14 acting on the stator). A further advantage of the clip 69 is that it provides a hardened metal wear surface 67 for engaging the ends of the stator if the plastic stop surface 27 were to wear away to expose the initially plastic-covered surface 67. If desired, the metal clip 69 could be initially positioned closer to plastic wear surface 27, particularly if very limited axial travel of the stator over the life of the rod guide were desired.

It is important that the internal diameter of the sleeve 24 mate with the outer diameter of the rod 12. Accordingly, it may be desirable to provide sleeve components each having a circumference of less than 180°, so that the sides of the components are spaced apart and thus cannot interfere with proper installation of the components on the rod. The total circumference of the sleeve components preferably is more than 220°, however, so that the sleeve 24 has the desired wear material to prevent the stator 22 from contacting the rod 12.

FIG. 4 discloses a rod guide rotor 25A similar to rotor 25 described above. The two arcuate metal sleeve components 72 again are identical, each having a circumference of about 175°, thereby forming an elongate gap between the edges of the two sleeve components. The inner surface of each sleeve component 72 is covered with a thin rubber layer 73 to significantly increase the static friction between the rod 12 and the metal sleeve components and thereby reduce the likelihood of the metal sleeve rotating on the rod. This rubber layer 73 also reduces galvanic corrosion between the metal sleeve and the rod. Preferably, the elongate gap between the edges of the sleeve components may also be filled with rubber, so that two strips 74 of rubber are formed, each having an outer surface approximating the diameter of the sleeve components. The rubber strips 74 as shown in FIG. 4 may be formed by providing a layer of rubber covering the elongate edge of each metal sleeve component 72, within this rubber layer being significantly thicker than the layer 73 provided on the inner surface of each metal sleeve component. By way of example, the layer 73 may be from 0.006 to 0.020 inches thick, while the edge layer of rubber covering the edge of each metal sleeve component may be from 0.010 to 0.080 inches thick. The edge rubber layers are thus pressed into engagement during installation of the metal sleeve components on the rod 12, so that mating edge rubber layers effectively form each of the elongate rubber strips 74 to fill the gap between the edges of the metal sleeve components. The rubber layers 73 and the edge rubber layers forming rubber strips 74 may be coated or otherwise bonded to the metal sleeve components 72 by conventional processes.

Metal clips may be used to hold the components 72 in place while the end members are injection molded on the rod. It should be understood that other holding members, such as a plastic or rubber O-ring, may be used to hold the sleeve components in place during the operation of molding the end members on the rod. Also, the sleeve components may be glued to the rod prior to the end member injection molding operation. The glue need not retain the sleeve components in place during use of the rod guide, however, since the injection molded end members serve that purpose once installed. The lower stop surface 27 for engagement with the end pads 60 of the stator is depicted in FIG. 4. Also the plastic material forming the end stops could be injection molded to fill the gap or gaps between the sleeve components.

Figure 5:
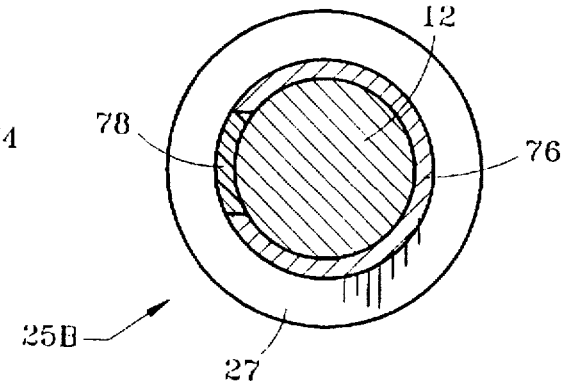
FIG. 5 is yet another embodiment of a rod guide, illustrating a cross-sectional view of the sleeve and one of the stops, with the stator removed for clarity.

For the embodiment depicted in FIG. 5, a single component metal sleeve 76 having a C-shaped cross-sectional configuration is used to form the rotor 25B. The sleeve 76 has a circumference of from about 200° to about 320°, so that a comparatively wide gap exists between the sleeve sides. This gap, if unfilled, may be useful for channeling fluid between the stator and the rotor as further washing action. As shown in FIG. 5, however, this gap is filled with plastic 78 during the process of injection molding the end members. The material for the sleeve 76 must be sufficiently flexible to allow the gap between the sleeve sides to spread apart while the sleeve is moved radially onto the rod 12, then must allow the sleeve to spring back to its original configuration, as shown in FIG. 5, with substantially the entirety of the inner surface of the sleeve in engagement with the outer surface of the rod. The sleeve 76 need not require any other components to hold the sleeve in place during the molding of the end members. The elongate plastic strip 78 prevents rotating of the metal sleeve 76 on the rod 12. Although not shown in FIG. 5, a rubber layer on the inner surface of the metal sleeve 76 may be provided in a manner similar to the FIG. 4 embodiment. This rubber layer also prevents the metal sleeve from direct contact with the rod, thereby minimizing galvanic corrosion and the likelihood of stress points on the rod created by scratches or grooves on the surface of the sucker rod. As previously noted, the stator as shown in FIGS. 1 and 2 may be installed on the rotor for any of the embodiments discussed above.

Figure 7:
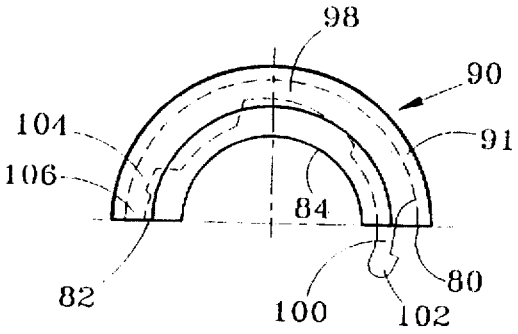
FIG. 7 is a top view of one-half portion of the stop member as shown in FIG. 6, illustrating the configuration of the metal retaining ring.
Figure 6:
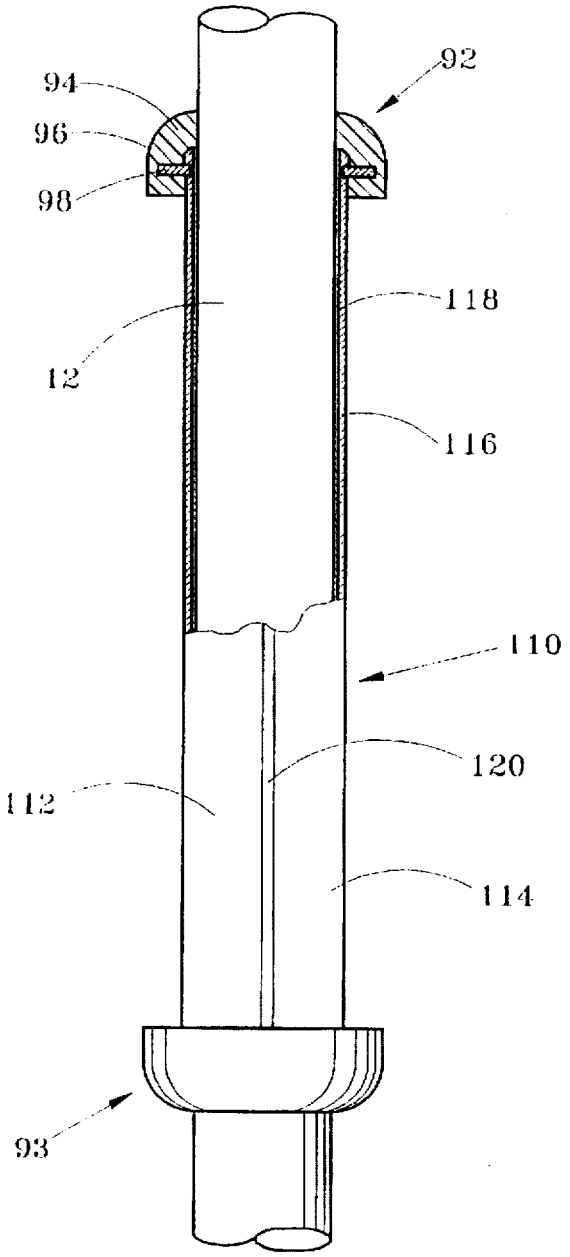
FIG. 6 is a side view of another embodiment of a rod guide, partially in cross-section, with the stator removed for clarity.

FIG. 6 illustrates another embodiment of a rotor 110 for receiving a stator as previously described. The rotor 110 includes a metal sleeve 112 having identical sleeve components 114 with sides separated by a slight gap similar to the FIG. 4 embodiment. Each sleeve component 114 includes a metal outer layer 116 and a thin rubber inner layer 118 bonded to the inner surface of the metal sleeve component. The inner layer 118 substantially increases the static friction between the rod 12 and the sleeve components in a manner similar to the FIG. 4 embodiment. Elongate rubber strips 120 between the edges of sleeve components 114 are similar to the strips 74 previously discussed. Two sleeve components are positioned on a cleaned rod during installation, then a pair of identical stop halves 90 as shown in FIG. 7 snapped together to form each of the end members 92 and 93 which secure the upper and lower ends of the sleeve components on the rod and effectively replace the injection molded end members previously discussed. The plastic body 94 of each end member may have a curved outer surface 96 as shown in FIG. 6, or may have a frustoconical surface as shown in FIG. 3. The metal clip or retaining ring 98 fits within a groove provided in the metal sleeve components, as previously discussed.

FIG. 7 depicts one of the components 90 which cooperate with a similar component to form an upper or lower stop member 92 or 93. Each component 90 includes a retaining ring 98 having a generally C-shaped configuration, and a plastic body 91 which may be injection or compression molded about the retaining ring. The plastic body 91 also has a C-shaped configuration, so that end surface 80 of one body 91 is pressed firmly against end surface 82 of the mating body 91 to form one field installed stop.

The end 100 of the clip 98 extends outward from plastic body surface 80, while the opposing end 104 of the clip is housed within the plastic body. Each clip end has corresponding dog member 102 and 106 for securely interconnecting a pair of clip end members and thus the plastic bodies 91 during installation on the rod 12. A suitable metal retaining ring according to the present invention is a interlocking external Series 5167 ring manufactured by Waldes Truarc, Inc.

Figure 8:
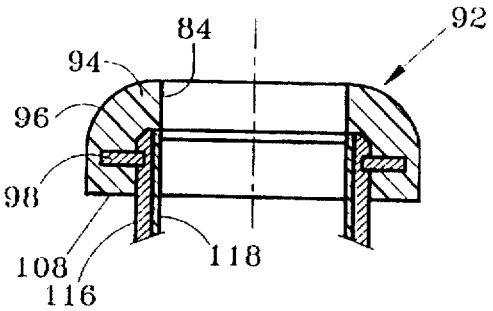
FIG. 8 is a cross-sectional view of an upper end member of a rod guide rotor and a portion of the sleeve as generally shown in FIG. 6, with the rod removed for clarity.

Referring to FIG. 8, the upper end member 92 is shown with an internal cylindrical surface 84 for fixed engagement with a rod 12. The metal sleeve components which act as a preferred wear surface for engaging the stator include an upper groove and a lower groove for receiving a respective retaining ring. The interconnecting force of the mating retaining rings may be sufficient to fix the stop members and thus the rotor to the metal rod. If desired, however, a rubber layer may be provided on the inside of the cylindrical surface 84 of the stop member to increase static friction between the stop member and the rod, and thereby serve a purpose similar to the rubber layer 73 provided on the inside of the sleeve component 72 as shown in FIG. 4. This rubber layer 118 would thus be highly compressed once the pair of components 90 were snapped together in place on the rod.

Referring again to FIG. 6, it should be understood that the sleeve components may be placed on a cleaned rod 12, and two components 90 then pressed together until the mating dogs 102 and 106 lock one of the stop members onto the rod, with the retaining ring 98 fitting within the corresponding groove provided in the metal sleeve components. The other stop member may be similarly snapped together at the other end of the metal sleeve components in a relatively simple field installation. If the plastic member end surface 108 of the field installed stop as shown in FIG. 8 were to wear sufficiently during use of the rod guide, the metal retaining ring 98 would act as a backup wear surface for engaging the end of the stator. After installation of the rotor as described above, the stator may be easily fitted on the rotor using a conventional tool to spread apart the slot to snap the stator over the sleeve portion of the rotor and between the end members.

The embodiment as shown in FIGS. 6–8 has a substantial advantage in that the rotor may be field installed since the end members are not injection molded on a rod. Those skilled in the art will appreciate that these embodiments are not preferred for many applications, however, because of an increased likelihood that the rotor will rotate relative to the rod when the guide is in use. To reduce the likelihood of inadvertent rotation of the field installed rotors on the rod, a glue or other adhesive may be used to affix the sleeve components and/or the end member to the rod. Also, bolts or similar connecting devices may be used to draw the sides of the end members closer together, thereby effectively clamping the end members on the rod. Such clamping devices add considerably to the cost and complexity of a rod guide, however, and accordingly are not preferred.

Figure 9:
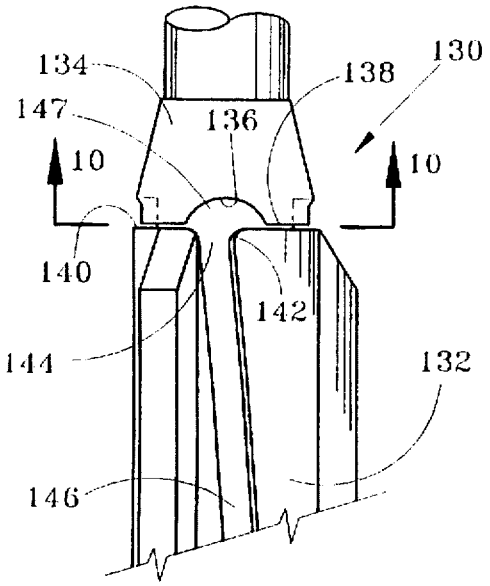
FIG. 9 is a side view of an upper portion of still another embodiment of a rotating rod guide.
Figure 10:
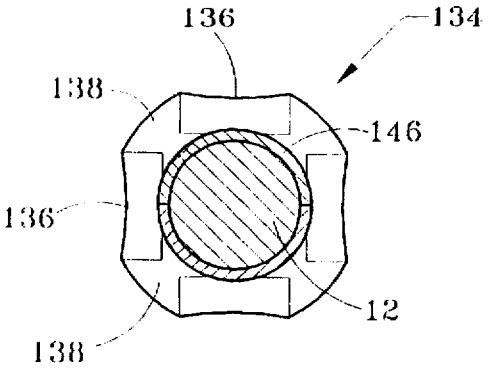
FIG. 10 is a cross-sectional view through the stop member shown in FIG. 9.

FIGS. 9 and 10 disclose another embodiment of a rotatable rod guide 130. The stator 132 may be similar to the stator 22 previously discussed, except that the ends of the stator need not be cut-out or scalloped to form pads for engaging stop surfaces on the end members. Instead, both the upper and lower end members 134 are provided with cut-outs or scallops 136 which extend radially to expose the end portion 147 of the sleeve 146 (which may extend axially beyond the scallops), and thereby forming end pads 138 for engagement with the end surface 140 of the stator. To reduce the likelihood of the stator catching on the end member 134, the upper and lower corners of the stator adjacent the ends of the slot 144 may be rounded at 142, as shown in FIG. 9.

The scallops 136 provided in the end members 134 serve to facilitate washing action between the stator and the rotor, and prevent the build-up of debris between the end of the stator and the end member.

The configuration of the end members 134 is shown in FIG. 10. Four scallops 136 are provided about the circumference of the end member, thereby forming four pads 138 which serve as stop surfaces for limiting axial travel of the stator with respect to the rotor. A metal clip may be used to secure the sleeve on the rod prior to injection molding the end members, as described above. The end members 134 may be injection molded on the rod 12, and retain the metal sleeve 146 on the rod in a manner similar to the FIG. 1 embodiment. The metal sleeve 146 may alternatively be similar to the FIG. 4 or FIG. 5 embodiment.

Figure 11:
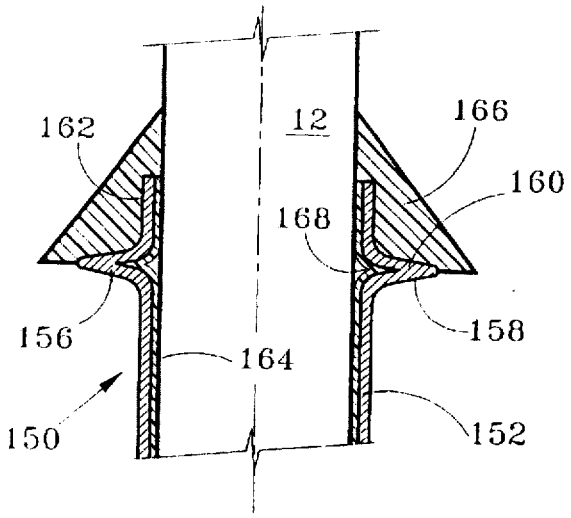
FIG. 11 is a cross-sectional view of another embodiment of a rotor for a rod guide.
Figure 12:
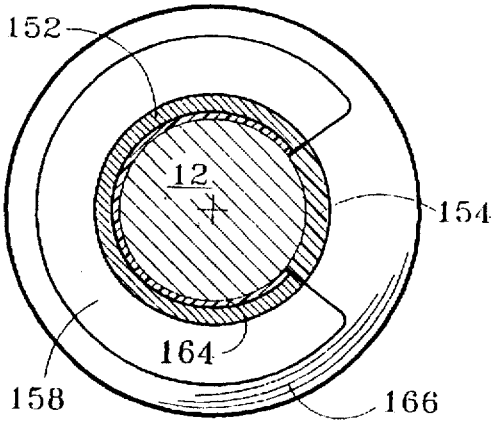
FIG. 12 is a cross-sectional view of the sleeve and one of the stops for the rotor as shown in FIG. 11.

FIGS. 11 and 12 disclose another embodiment of a rotor 150 for a rod guide. The stator as shown on FIGS. 1 and 2 may be installed on the rotor 150. The rotor 150 in cross-section may have a substantially C-shaped body 152 as generally shown in FIG. 12 circumferentially positioned about 270° of the rod 12. The annular gap over approximately 90° between the ends of the body 152 is filled with plastic when the end members are molded in place, thereby forming an elongate strip 154 having an outer surface cooperative with the metal body 152 to form a substantially uniform diameter cylindrical surface for engagement with the stator. The upper and lower ends of the rotor may be identical.

The metal body 152 may be formed by a stamping operation to form a shoulder 156 as shown in FIG. 11. Lower bend 158 projects radially outward, and upper bend 160 then projects back inward. Extension 162 extends from the upper bend and has a configuration substantially identical to the body 152. A rubber layer 164 is bonded on the inner surface of the metal body, and also may substantially fill the gap 168 between the lower and upper bends. The upper and lower plastic end members 166 may totally or partially encapsulate the flanges 156, and are integrally connected by plastic strip 154.

The flanges or shoulders 156 may be formed on the ends of the C-shaped body 152 after the rubber layer 164 is bonded to the inner surface of the metal body. The body 152 may then be spread apart and snapped onto a rod 12. If necessary, the metal body may be squeezed to compress the rubber layer 164, and the plastic end members 166 then molded on the ends to hold the body 152 on the rod. When the plastic end members 166 are molded on the rod, the annular gap between the ends of the C-shaped body 152 will be filled with plastic, thereby forming strip 154 as shown in FIG. 12. The lower surface 158 of the flange 156 thus forms a stop surface for engagement with the ends of the stator. If the plastic end members 166 fully encapsulate the flanges, the plastic end members may form a stop surface for engaging the stator in a manner similar to the embodiment as shown in FIG. 3. In this case, the flanges would then provide a metal backup stop surface after the plastic stop surface was worn. A metal sleeve with upper and lower flanges could be formed from two C-shaped sleeve components in a manner similar to the FIG. 4 embodiment. Retaining rings could be provided above and below the flanges to secure the metal sleeve on the rod prior to injection molding the end members on the rod, thereby encapsulating the retaining rings in plastic. Since the flanges rather than plastic surfaces on the end members and/or the retaining rings serve as the stop surfaces for engaging the ends of the stator, a rubber O-ring, clamp, or other removable holding device may be used to secure the two opposing metal sleeve components on the rod while the plastic end members are molded in place. The holding devices may then be removed after the molding operation, and may be reused on another rotor.

Figure 13:
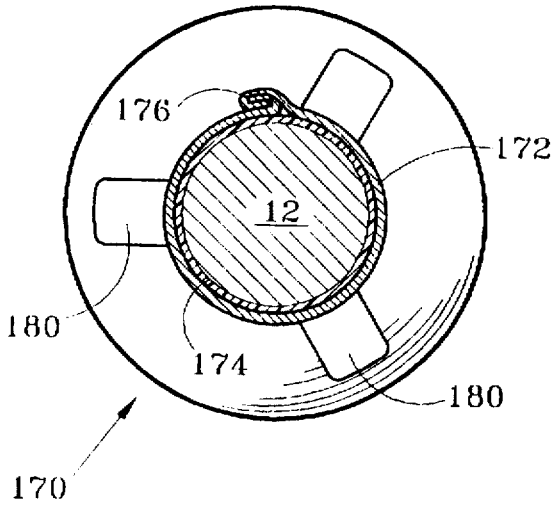
FIG. 13 is a cross-sectional view of another embodiment of a sleeve and one of the stops for a rotor.
Figure 14:
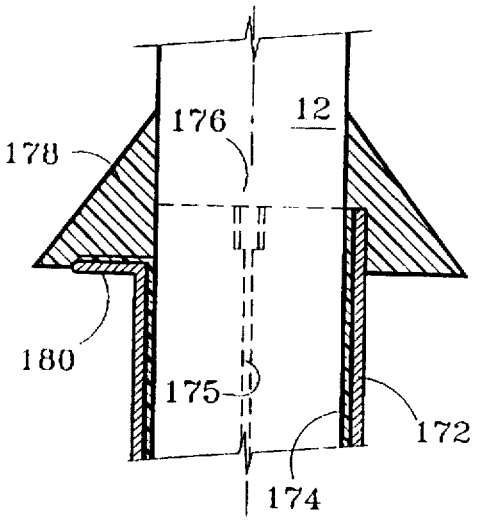
FIG. 14 is a cross-sectional view of the rotor as shown in FIG. 13.

FIGS. 13 and 14 illustrate yet another embodiment of a stator 170. The metal sleeve 172 again includes a rubber layer 174 bonded thereon, and substantially encircles the rod 12. The sides of the metal sleeve, and more preferably the rubber layer covering the sides of the metal sleeve, may be butted together as shown in FIG. 14. A thin elongate gap 175 between the sides of the metal sleeve may thus be filled with rubber. The upper and lower ends of the metal sleeve include side connections which are deformed to form interconnecting S-ends which hold the metal sleeve in place on the rod prior to molding the stops on the rods. Each of the S-ends 176 may be similar to the interconnection of a sheet metal joint, and each connection 176 is encased in the plastic end member 178 which is subsequently molded on the rod.

Upper and lower tab ends of the metal sleeve are bent to form bearing tabs 180. As with other embodiments described above, the plastic end members 178 could fully encapsulate the bearing tabs 180, in which case the metal bearing tabs 180 would provide a backup metal stop surface for engaging the stator. From two to four bearing tabs may be equally spaced around the circumference of the rod, and three such bearing tabs are shown in FIGS. 13 and 14. The lower end of the rotor 170 may be constructed similar to the depicted upper end. The stator as previously described and as shown in FIGS. 1 and 2 could be snapped in place on the rotor 170.

Figure 15:
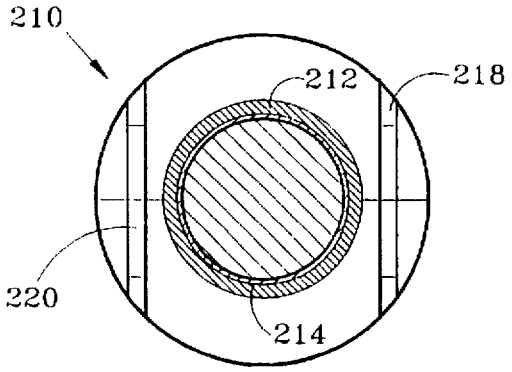
FIG. 15 is a cross-sectional view of a field-installed rotor according to the present invention.

FIG. 15 discloses a rotor 210 comprising two substantially identical metal bodies 212 each covering 180° of a rod. Each metal body 212 includes a rubber inner layer 214 bonded thereto. A slight gap between adjoining sides of the metal bodies may be filled with rubber in a manner similar to the FIG. 4 embodiment. Each body also includes a flange 216 having a pair of passageways 218 therein. The two bodies 212 may be placed on a rod, and a pair of roll pins 220 as shown in FIG. 15 then pressed into passageways 218 to hold the bodies in place on the rod. The plastic end members 222 may then be molded on the rods, partially encapsulating the flanges 216.

Figure 16:
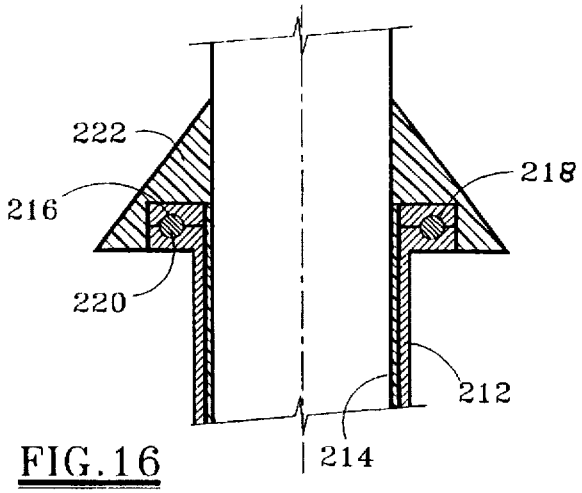
FIG. 16 is a cross-sectional view of the rotor as shown in FIG. 15.

The rotor 210 as shown in FIGS. 15 and 16 may be modified so that the rotor is field installable. For this embodiment, the plastic end members 222 may be molded on each body 212 before the bodies are installed on a rod. After fitting elongated roll pins in the passageways 218, the ends of the roll pins extending from the passageways 218 may be deformed, thereby securely fixing the metal halves on the sucker rod. When deforming the ends of the roll pins, the metal body halves may be squeezed together, thereby compressing the rubber layer 214.

Figure 17:
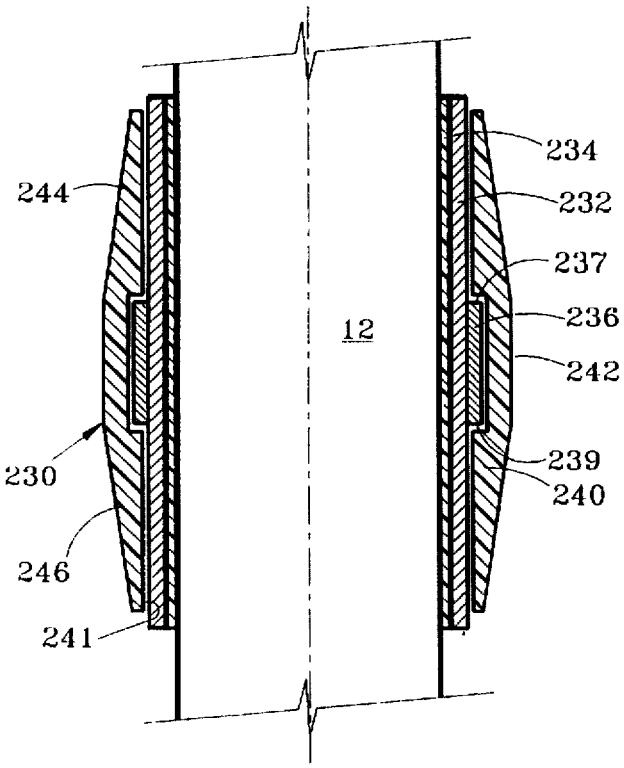
FIG. 17 is a cross-sectional view of another embodiment of a rotatable rod guide according to the present invention.

FIG. 17 discloses yet another embodiment of a rod guide 230. The rod guide includes a metal sleeve 232 preferably having a rubber or other elastomeric layer 234 on the inner surface thereof. The rotor also includes a metal ring member 236 affixed to the metal sleeve and spaced approximately midway between the upper and lower ends of the metal sleeve. As explained subsequently, the metal sleeve includes stop surfaces 237 and 239 which limit axial travel of the stator with respect to the sucker rod 12.

Figure 18:
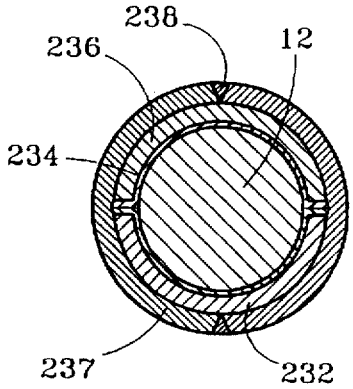
FIG. 18 is a cross-sectional view of the rotor as shown in FIG. 17.

As shown in FIG. 18, the metal sleeve 232 may be formed in substantially the same manner as the sleeve discussed above and shown in FIG. 4. The ring member 236 replaces the purpose of the retaining clips and the plastic end members used in that embodiment to hold the metal sleeve on the sucker rod 12. The ring member includes a pair of substantially identical short metal sleeve components 237 which are welded together at radially opposing welds 238. Preferably, the welds 238 are circumferentially spaced from the adjacent sides of the components which form the metal sleeve 232, as shown in FIG. 18. The metal sleeve 232 prevents the welds 238 from damaging the metal sucker rod 12. A clamp or other suitable securing member (not shown) may be used to retain the metal sleeve 232 on the sucker rod 12 while compressing the elastomeric layer 234 prior to the welding operation.

The stator 240 includes a radially inner body having an axially extending slot therein (not shown) for mounting the stator on the rotor as previously discussed, and also includes a plurality of vanes as shown in FIG. 1 extending radially outward from the body. The stator body includes a radially inner ring-shaped cavity sized for receiving the ring member 236. The otherwise generally cylindrical inner surface 241 of the stator may be slightly larger than the outer diameter of sleeve 232 to facilitate rotation of the rotor about the stator. The stop surfaces 237 and 239 on the ring member 236 thus limit axial travel of the stator. The central portion of the stator adjacent the ring member 236 may have a generally cylindrical outer surface 242. The upper and lower surfaces 244 and 246 between the cylindrical surface 242 and the ends of the stator may be slightly tapered as shown in FIG. 17 to reduce the mass of the stator while providing a smooth contour for promoting streamline fluid flow and reducing the pressure drop across the stator. Since upper and lower end members with stop surfaces thereon are not utilized for limiting axial travel of the stator, scallops at the ends of the stator 240 need not be provided.

It is also possible to spot weld the edges of the metal sleeve components together. For this embodiment, the metal component edges are in contact, as shown in FIG. 2, or are separated by a very narrow elongate gap. The metal sleeve components are protected from engaging the rod 12 by a thin rubber or plastic layer, as shown in FIG. 4. The rubber or plastic layer shields the rod from the welding process, and serves the further purposes described above. As the weld cools and contracts, the sleeve is secured to the rod in the manner of a shrink fit.

Figure 19:
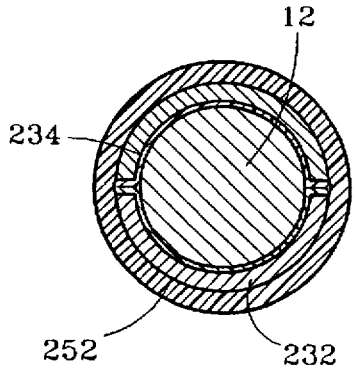
FIG. 19 is a cross-sectional view of another embodiment of a rotor.

FIG. 19 discloses yet another embodiment of a rotatable rod guide. The embodiment as shown in FIG. 19 is substantially the same as the embodiment discussed above, except that the metal ring member 236 in FIG. 18 has been replaced with a one-piece plastic ring member 252. The metal sleeve 232 may thus be placed on the rod 12 and held in place by any suitable securing member, such as rubber O-rings sized to slip over the upper and lower ends of the metal sleeve 232. The sucker rod 12 with the metal sleeve thereon may then be passed through a mold, and the plastic ring member 252 injection molded on the metal sleeve. If desired, a one piece or two piece component metal sleeve may be used. Any substantially wide gap between sides of the metal sleeves may be filled with plastic while the ring member is molded in place.

In other embodiments, a sleeve may be molded or otherwise retained on the rod. The sleeve may include a plurality of elongate notches or splines which interrupt the circumference of the sleeve. These grooves, indentations, or notches form additional washout or cleansing channels which minimize the likelihood of debris becoming trapped between the stator and the rotor.

Those skilled in the art will appreciate that any number of fins or vanes may be provided on a guide body, although preferably at least three and less than seven such fins are provided. For many applications, three circumferentially spaced fins are preferred. The design of the rotating rod guide according to the present invention, along with the selection of material as discussed above, provide high protection for the rod and maximize the benefit to the fluid pumping operator. The field serviceability feature of the rod guide is a significant advantage of this invention compared to prior art designs. If a rod guide stator becomes worn down to the point that the rod or rod coupling contacts the tubing, the rod guide stator can be snapped off the rotor and a new stator snapped on the rotor in its place. This is a significant feature when using more durable metal rotors which have a much longer life than the prior art plastic material rotors. The rod need not be returned to the shop for installation of the guide bodies, and the replacement operation is easily accomplished in the field.

The design of the rod guide according to the present invention also allows for a number of different materials to be utilized to form the rotor. The outer sleeve portion of the rotor may be fabricated from metal sheet stock, as described above, but also could be fabricated from a ceramic material. An elastomeric material other than rubber may be used to increase frictional engagement between the outer wear resistance sleeve material and the sucker rod, and prevent galvanic corrosion. The body of the end members of each rotor may be plastic, with the retaining clip being a hardened metal. Various mechanisms may be used to bond or secure the rotor to the rod. Various alternative techniques may thus be used to form a suitable rotor and mechanically fix the spool to the rotor, either permanently or temporarily. Those skilled in the art will further appreciate that the sleeve member of the rotor may extend substantially, although perhaps not completely, between the end members, while still providing the desired purpose of positioning the stator about the rod.

As previously noted, the material for the stator is a significant feature of the present invention, although various moldable or machinable materials other than UHMW polyethylene may be provided. Any polymer resin or alloy of polymers that provide suitable performance in tensile strength, elongation, impact properties and low coefficients of friction may be used. Polymers having molecular weight above 500,000 are likely candidates. Bronze and brass are likely candidates for fabricating a metal stator, and these metal materials would make the stator more wear resistant than if fabricated from standard plastic materials. The stop surfaces on the rotor end members also may be spaced apart axially a distance substantially greater than the axial length of the stator.

According to the method of the present invention, excess rotors may be initially molded on a rod, e.g., rotors in excess of the number of stators desired along that length of rod may be provided above or below the rotor intended for initial use with a stator. A rubber sleeve or adhesive tape (not shown) may be placed over an unused rotor to simply protect the rotor from wear, with this rubber sleeve having an outer diameter only slightly greater than the rotor and thus not serving to centralize the rod within the production tubing. If one or more of the rotors should become excessively worn, the stator may be removed from the worn rotor, the protective rubber sleeve removed from the previously unused rotor spaced above or below the worn rotor, and a new stator then snapped onto the unused rotor. This feature even further reduces the overall cost of maintaining the rod string centered within the tubing string, since the return of sucker rods to the manufacturing facility for molding on new rotors is substantially reduced or eliminated.

According to the method of the present invention, a rod guide is positioned on a sucker rod by securing a rotor and a stator to the sucker rod. The stator is formed having a passageway therein for receiving the sleeve portion of the rotor, with the stator having a slot with a width selected as a function of the construction material for the stator and the diameter of the sleeve portion of the rotor. The stator may then be moved radially inward with respect to the sleeve member of the rotor, and the spreading force then released to allow the stator slot to substantially return to its original width. The passageway in the stator may have an interior diameter greater than the diameter of the sleeve member of the rotor, and the slot has a width sufficient to facilitate flow in and out of an annulus between the stator and the rotor. Cut-outs may be formed in the stator to provide communication to and from the annulus between the stator and the sleeve member of the rotor, with the cut-outs providing a plurality of pads for engagement with stop surfaces on corresponding rotor end members.

The concepts of the present invention, while particularly well suited for protecting a rotating rod used to drive a downhole progressing cavity pump, may also be applied for protecting other tubular goods which are rotating within a wellbore. The rod guide may be used as a field installed guide or scraper on a reciprocating sucker rod. The extended wear rotor according to this invention could also be used for a rod guide wherein at least a substantial length of the internal surface of the stator and the external surface of the rotor are sealed rather than being exposed to well fluids. The concepts of the present invention may thus be used to devise a guide for protecting a drill pipe rather than a sucker rod, since engagement of a rotating drill pipe with a casing string or open hole also results in excessive wear on either the drill pipe string or the casing string.

The foregoing disclosure and description of the invention are thus illustrative, and changes in both the apparatus of the rod guide and in the method of constructing and operating a rod guide as described above may be made with departing from the present invention.

What is claimed:

1. A rod guide for centering a rotatable sucker rod transmitting power to a downhole pump within a wellbore, the sucker rod being rotatable within a tubular string, the rod guide comprising:

a rotor secured to a sucker rod, the rotor having upper and lower stop surfaces thereon, and a sleeve member having an outer surface circumferentially covering at least 200° of the sucker rod, the sleeve member outer surface formed from a wear resistant material selected from the group consisting of metal and ceramic;

a plastic material stator having an elongate slot therein extending along the axial length of the stator and a plurality of radially outwardly extending fins, the stator having an inner surface for engagement with the outer surface of the sleeve member, and the stop surfaces limiting axial travel of the stator with respect to the sucker rod; and an elastomeric layer between the sleeve member and the sucker rod.

2. The rod guide as defined in claim 1, wherein the rotor further comprises upper and lower plastic end members molded on the sucker rod, each plastic end member encasing a respective one of an upper end and lower end of the sleeve member with an end surface of each said plastic end member forming said upper and lower stop surfaces, respectively.

3. The rod guide as defined in claim 1, further comprising:

an upper clip and a lower clip each securing the sleeve member on the sucker rod; and the sleeve member has an upper groove and a lower groove for receiving the upper clip and lower clip, respectively.

4. A rod guide for centering a rotatable sucker rod transmitting power to a downhole pump within a wellbore, the sucker rod being rotatable within a tubular string, the rod guide comprising:

a rotor secured to a sucker rod, the rotor having upper and lower stop surfaces thereon and a sleeve member having an outer surface and circumferentially covering at least 200° of the sucker rod, the sleeve member outer surface formed from a wear resistant material selected from the group consisting of metal and ceramic;

a stator having an elongate slot therein extending along the axial length of the stator, the stator having an inner surface for engagement with the outer surface of the sleeve member, and the stop surfaces limiting axial travel of the stator on the sucker rod; and an electrically non-conductive material layer between the sleeve member and the sucker rod to minimize galvanic corrosion.

5. The rod guide as defined in claim 4, wherein the sleeve member comprises:

first and second axially elongate and radially opposing arcuate members, each of the first and second arcuate members extending circumferentially about the sucker rod from greater than 100° to less than about 180°.

6. The rod guide as defined in claim 4, wherein the rotor further comprises upper and lower plastic end members molded on the sucker rod, each plastic end member encasing a respective one of an upper end and lower end of the sleeve member, with an end surface of each said plastic end member forming said upper and lower stop surfaces, respectively.

7. The rod guide as defined in claim 4, wherein the sleeve member comprises a metal sleeve having a C-shaped cross-sectional configuration and the electrically non-conductive layer comprises an elastomeric material.

8. The rod guide as defined in claim 4, wherein the outer surface of the sleeve member has substantially a cylindrical configuration, and wherein the inner surface of the stator for engagement with the outer surface of the sleeve member has a substantially cylindrical configuration.

9. The rod guide as defined in claim 4, wherein the stator is fabricated from an ultra high molecular weight polyethylene material.

10. The rod guide as defined in claim 4, further comprising:

an upper clip and a lower clip each securing the sleeve member on the sucker rod.

11. A rod guide for centering a rotatable sucker rod transmitting power to a downhole pump within a wellbore, the sucker rod being rotatable within a tubular string, the rod guide comprising:

a rotor secured to a sucker rod, the rotor having upper and lower stop surfaces thereon and a sleeve member having an outer surface and circumferentially covering at least 200° of the sucker rod, the sleeve member outer surface formed from a wear resistant material selected from the group consisting of metal and ceramic;

a stator having an elongate slot therein extending along the axial length of the stator, the stator having an inner surface for engagement with the outer surface of the sleeve member, and the stop surfaces limiting axial travel of the stator on the sucker rod; and an upper metal clip and a lower metal clip securing the sleeve member to the sucker rod, each metal clip forming said upper and lower stop surfaces, respectively.

12. The rod guide as defined in claim 11, further comprising:

an upper groove and a lower groove in said sleeve member receiving the upper metal clip and lower metal clip, respectively.

13. The rod guide as defined in claim 11, wherein the sleeve member comprises a metal sleeve having a C-shaped cross-sectional configuration.

14. The rod guide as defined in claim 11, wherein the sleeve member comprises:

first and second axially elongate and radially opposing arcuate members, each of the first and second arcuate members extending circumferentially about the sucker rod from greater than 100° to less than about 180°.

15. The rod guide as defined in claim 11, wherein the rotor further comprises upper and lower plastic end members molded on the sucker rod, each plastic end member encasing a respective one of an upper end and lower end of the sleeve member.

16. The rod guide as defined in claim 11, wherein the stator is formed from a plastic material, and wherein the rotor further comprises upper and lower plastic end members molded on the sucker rod.

17. The rod guide as defined in claim 11, wherein the stator is fabricated from an ultra high molecular weight polyethylene material.

18. The rod guide as defined in claim 11, wherein the outer surface of the sleeve member has substantially a cylindrical configuration, and wherein the inner surface of the stator for engagement with the outer surface of the sleeve member has a substantially cylindrical configuration.

19. The rod guide as defined in claim 11, wherein:

the inner surface of the stator has a generally cylindrical diameter greater than a diameter of the outer surface of the sleeve member, thereby forming a generally annular gap between the stator and the sleeve member.

20. The rod guide as defined in claim 11, further comprising:

an inner elastomeric layer between the sleeve member and the sucker rod.

* * * * *